United States Patent [19]

Gregoire et al.

[11] 4,113,243

[45] Sep. 12, 1978

[54] COMBINATION WEB TUCKER AND KNIFE WITH WEB GRIPPERS AND ANVIL

[75] Inventors: Clyde G. Gregoire, Bensenville; James A. Hartman, Brookfield; Joseph M. Gregoire, Berwyn, all of Ill.

[73] Assignee: Gregg Engineering Corp., Lyons, Ill.

[21] Appl. No.: 822,423

[22] Filed: Aug. 8, 1977

[51] Int. Cl.[2] ..... B41F 13/56

[52] U.S. Cl. ..... 270/21; 270/71

[58] Field of Search ..... 270/13, 19, 21, 60, 270/69, 71, 72, 47; 83/151-152, 154, 83, 84, 116, 119

[56] References Cited

U.S. PATENT DOCUMENTS

| | | | |
|---|---|---|---|
| 2,659,437 | 11/1953 | Huck | 83/154 |
| 3,757,620 | 9/1973 | Cloud | 83/152 |

*Primary Examiner*—Edgar S. Burr
*Assistant Examiner*—A. Heinz
*Attorney, Agent, or Firm*—Kenneth T. Snow

[57] ABSTRACT

An apparatus for the printing industry in which a web tucker and cutter on one operational roller engages a combination gripper means and anvil on a cooperative operational roller to cause a bight of a printed web to be inserted into the gripper means and simultaneously to effect a severing of the bight portion so that the gripper means engages the severed ends of the web for subsequent folding in the making of a booklet.

7 Claims, 8 Drawing Figures

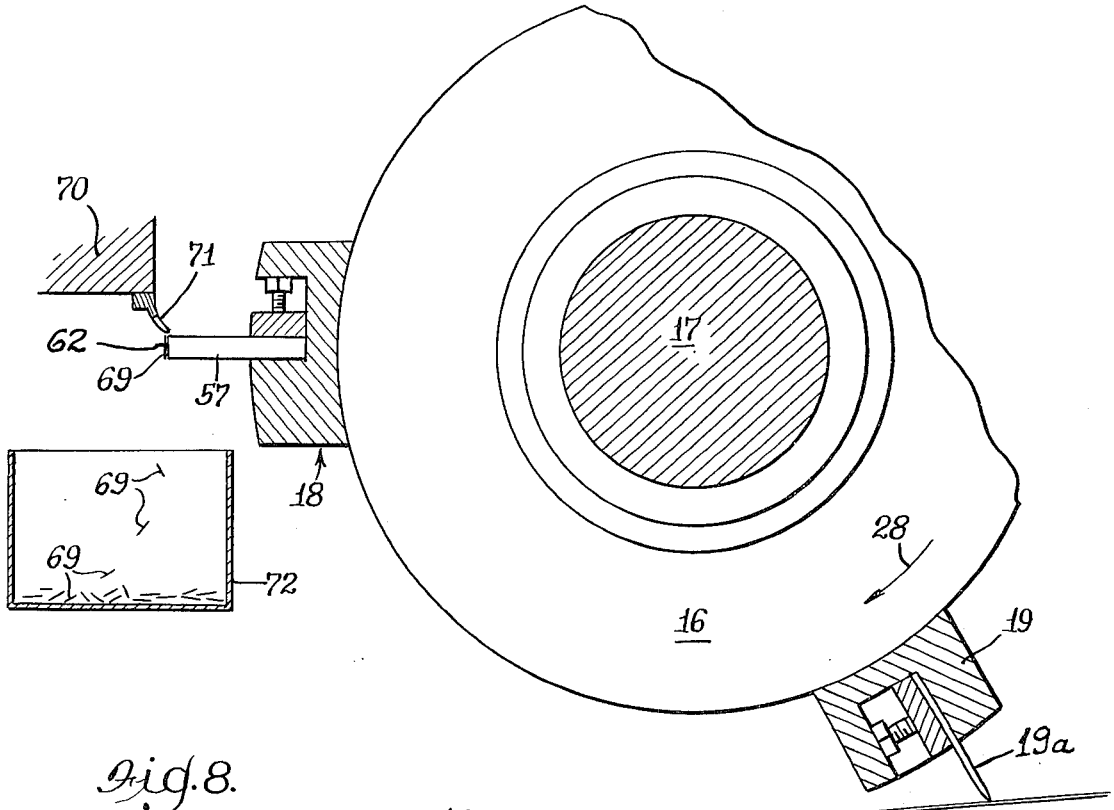
Fig. 8.
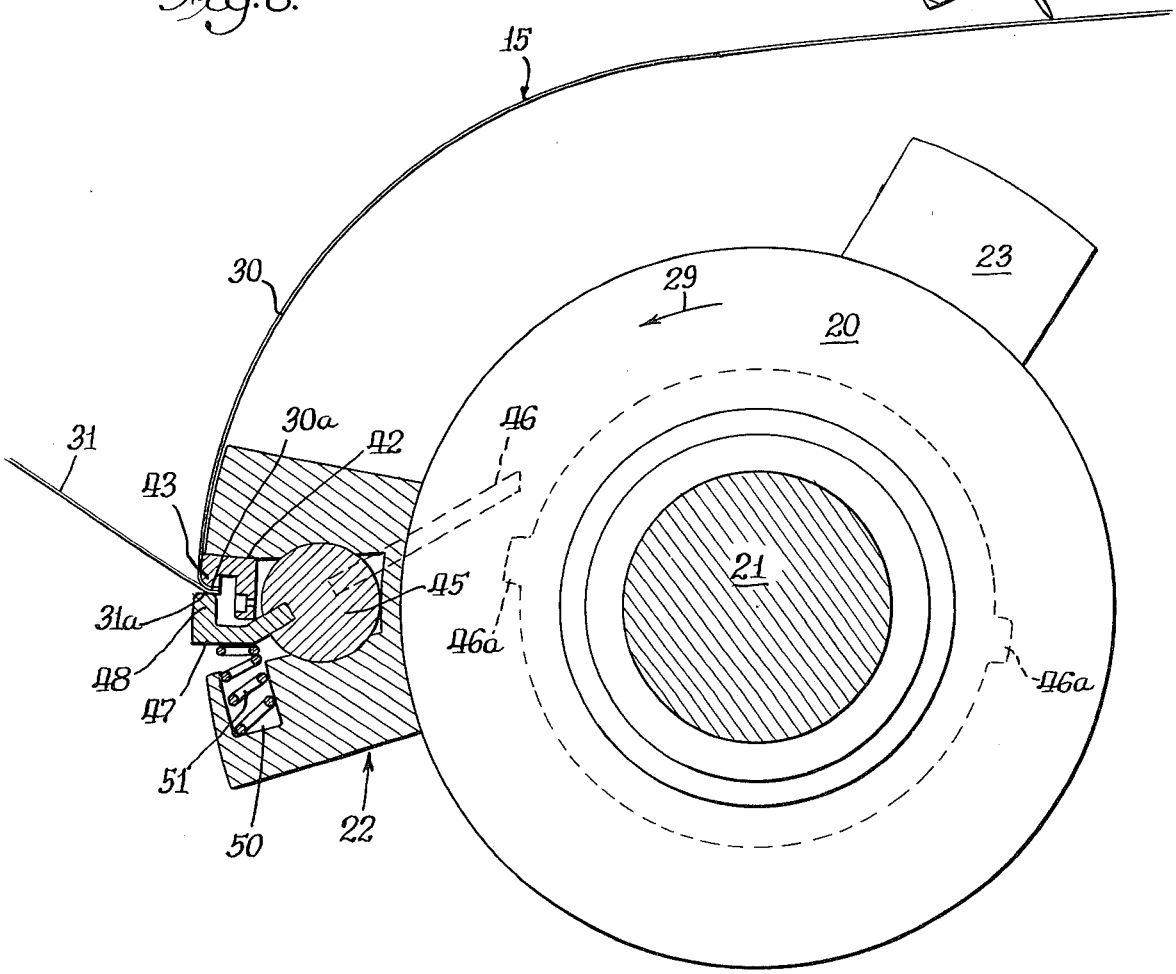

COMBINATION WEB TUCKER AND KNIFE WITH WEB GRIPPERS AND ANVIL

BACKGROUND OF THE INVENTION

1. Field of the Invention

The present invention concerns the printing industry and more particularly the printing of multiple page booklets from a continuously printed web which is folded and cut as necessary by tool holding work boxes mounted on cooperative operational rollers to accomplish the making of a multiple page booklet. Further, the present invention contemplates improvements over the prior art in the particular area of the tools provided in the boxes to effect a tucking of a bight of a printed web into cooperative open grippers and at the same time to effect a cutting of the web bight to thus divide the web into two pieces just prior to the gripping of the severed web portions. These combination functions performed at one station in the revolution of the operational rollers cause the elimination of the severing of the printed web at auxiliary stations around those cooperative operational rollers.

2. Description of the Prior Art

The prior art is best embodied in our own earlier presently pending patent application, Ser. No. 758,079, now U.S. Pat. No. 4,073,485, entitled APPARATUS FOR PRINTING MULTIPLE PAGE BOOKLETS. In our earlier patent application we defined in a detail manner the making of a multiple page booklet from a single continuously printed web. In that prior patent application we showed cooperative operational rollers engaging and performing work on a continuously printed web. One of these work steps involved the employment of a tucking tool on one operational roller to cause a tucking of a bight of printed web into the open jaws of a gripper mechanism on an adjoining operational roller. The uncut bight of the printed web was thus held in the gripping elements and the severing of the web was necessarily at a position spaced from the bight gripping elements. At this spaced apart station a cooperative knife on one operational roller and an anvil on the other operational roller effected a severing of the printed web. The present invention concerns the combination of these two work operations at one station whereby the printed web is not only tucked into web grippers but is simultaneously severed at the position of the formed bight so that the grippers act to hold the severed pieces of printed web.

Our own prior U.S. Pat. No. 3,857,314 shows and describes box-like, tool holding elements mounted externally of an operational roller in a manner to obtain infinite adjustment of the box on the roller. This same adjustable feature for the tool carrying boxes is utilized in our above mentioned copending application, Ser. No. 758,079, as well as in the subject application.

In addition our earlier U.S. Pat. No. 3,893,359 shows details of how trim-out portions of a web may be removed from the machine by the engagement of the trim-out with a pin and the subsequent stripping of that trim-out from the pin. The present invention utilizes the features and the environment of our own prior inventions but goes further in providing a new inventive concept in the environment of cooperative operational rollers; that of simultaneously tucking and cutting a printed web into web grippers and an anvil. This then provides for the simultaneous gripping of the bight of a printed web and the severing of that bight into two pieces in a single station of tangentially meeting tool holding boxes on cooperative operational rollers.

SUMMARY OF THE INVENTION

A principal object of the present invention is to provide a novel combination web tucker and knife for cooperation with a novel combination web gripper and anvil to both tuck a bight of a printed web into cooperative web grippers and to simultaneously cut the bight of the web into two portions so that the severed web portions are held by the web grippers.

An important object of this invention is to provide novel combination web gripping jaws having an anvil associated with one of the gripper jaws and arranged so that the anvil telescopes within the other of the gripper jaws when the jaws are closed to thereby avoid impairing the gripping feature of the jaws.

Another and further important object of this invention is to provide a novel combination of web tucking and gripping with a combination knife and anvil such that the printed web is tucked into the gripper members and simultaneously cut.

Another and still further important object of this invention is to provide a novel device in which a broad surfaced combination tucker and knife snuggly telescopes within a combination gripper and anvil to thereby tuck and sever spaced apart edges of the formed bight of the printed web and thereupon provide a scrap of the printed web between the spaced apart cut-off edges.

Another and still further important object of this invention is to provide a novel device of the preceding object in which the broad surfaced knife is provided with a scrap pick-up pin so that upon cutting the scrap the scrap is pinned to the knife whereby movement of the knife away from the cut simultaneously removes the scrap from the site of the cut.

Other and further important objects and advantages will become apparent from the disclosures in the following specification and the accompanying drawings.

IN THE DRAWINGS

FIG. 8 is still another enlarged detail sectional view of the device of FIGS. 6 and 7 with the cut and superposed pieces of printed web moved to a succeeding position and the scrap piece cut out of the web being stripped from its attachment to the roller.

AS SHOWN IN THE DRAWINGS

Figure 1:
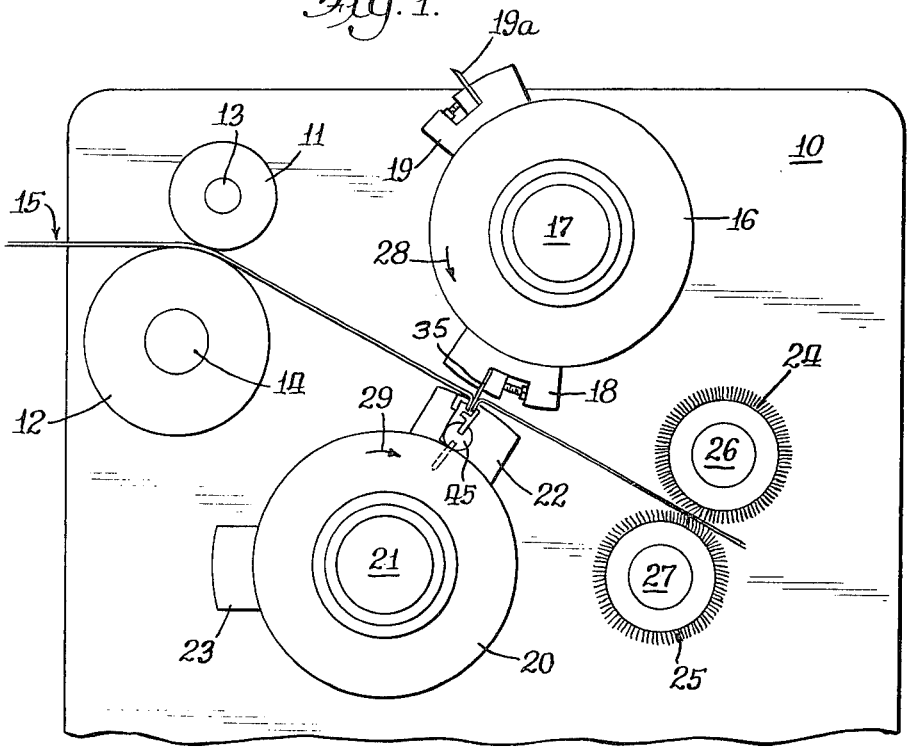
FIG. 1 is a vertical sectional view taken through a plurality of pairs of rollers arranged to receive a continuously printed web and the rollers acting to cut and superpose portions of the printed web.

The reference numeral 10 indicates generally a frame support for the web folding and cutting mechanism of this invention. The frame 10 carries cooperative web feeding rollers 11 and 12. The rollers are mounted on shafts 13 and 14 respectively which are journally mounted in the frame support 10. A printed web 15 is continuously delivered from a printing mechanism (not shown) into the cooperative feed rollers 11 and 12. It is these rollers that deliver the web 15 to the cutting and folding mechanisms of this invention.

A first operational roller 16 is mounted on a shaft 17 which in turn is carried in the frame support 10. As best shown in FIG. 1 the first operational roller 16 is provided with a first box 18 on its outer circumference carrying a combination tucker and knife which will later be described in detail. A second box 19 is also provided on the outer circumference of the first operational roller 16 at an arcuately spaced apart position thereon and this second box 19 carries a knife.

The cutting and folding device of this invention is provided with a second operational roller 20 which cooperates with the first operational roller 16 and its circumferentially mounted boxes to effect the folding and cutting of the printed web 15 as will hereafter be described. The second operational roller 20 is mounted on a shaft 21 which in turn is carried in the frame support 10. The second operational roller is provided with a first box 22 on its outer circumference carrying a combination gripper and anvil. The roller 20 is positioned in close proximity to the first operational roller 16 and arcuately indexed so that the first boxes 18 and 22 on the respective rollers come together in abutting cooperative relationship. The second operational roller is provided with a second box 23 on its outer circumference which carries an anvil. This second box 23 is arcuately spaced from the first box 22 an amount such that upon uniform rotation of the rollers 16 and 22 the boxes 19 and 23 will come together in abutting cooperative engagement.

The folding and cutting device of this invention is further provided with cooperative yieldably pulling brush rollers 24 and 25 and it is these rollers that support the end of the run of the printed web 15 and yieldably hold it in extended position from the cooperative feed rolls 11 and 12 and along the common tangent line of the cooperative first and second operational rollers 16 and 20. The brush rollers 24 and 25 are respectively provided with shafts 26 and 27 which in turn are journally mounted in the frame support 10. An arrow 28 on the first operational roller indicates its direction of rotation and similarly an arrow 29 on the second operational roller indicates its direction of rotation.

In the operation of the device of this invention the preprinted web 15 is delivered directly from a printing press to the cooperative feed rolls 11 and 12 and from there the web 15 proceeds in a straight line angularly downwardly and rearwardly between the cooperative first and second operational rollers 16 and 20 and from there to the cooperatively yieldably pulling brush rollers 24 and 25. It is in this position that the first boxes, 18 on the roller 16, and 22 on the roller 20, that come together in tangential abutting relationship. The combination tucker and knife of the first box 18 causes the printed web 15 to be inserted into the combination gripper and anvil of the first box 22 on the roller 20. In our earlier application mentioned above, and presently pending, the folding and cutting device effected a tucking of the printed web into a cooperative gripper to form a bight in the printed web. Further in our earlier device continued rotation of the operational rollers causes the bight of a single piece of web to be pulled around the second operational roller. One portion of the single piece of web overlies the other. In the present device the combination tucker and knife in the first box on the roller 16 not only causes a gripping of the printed web in the cooperative box 22 on the roller 20 but also effects a severing of the formed bight in the printed web so that there are two separate pieces of printed web superposed one above the other with the cut free ends gripped by the gripping mechanisms in the box 22. This advancement in the technique in the field of folding and cutting printed web makes the devices of the previous application and the present application much more versatile so that the printed web may be folded and cut in any manner to form booklets, folded circulars or brochures with a considerably lesser number of stations for boxes on the operational rollers.

Figure 3:
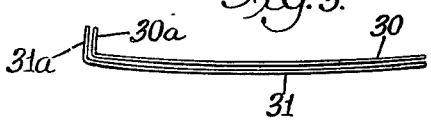
FIG. 3 is an enlarged side elevational view of superposed cut web sheets as made by the device of FIGS. 1 and 2.

FIG. 3 shows the pieces of printed web as the result of the combination tucker and knife elements with the combination grippers and anvil of the first boxes 18 and 22 on the operational rollers 16 and 20 respectively. The reference numeral 30 shows a cut piece of the printed web sheet 15 with a superimposed separate cut piece 31 of the same printed web 15 and the free ends thereof bent upwardly at substantially right angles thereto as shown at **30*a* and 31*a***.

Figure 4:
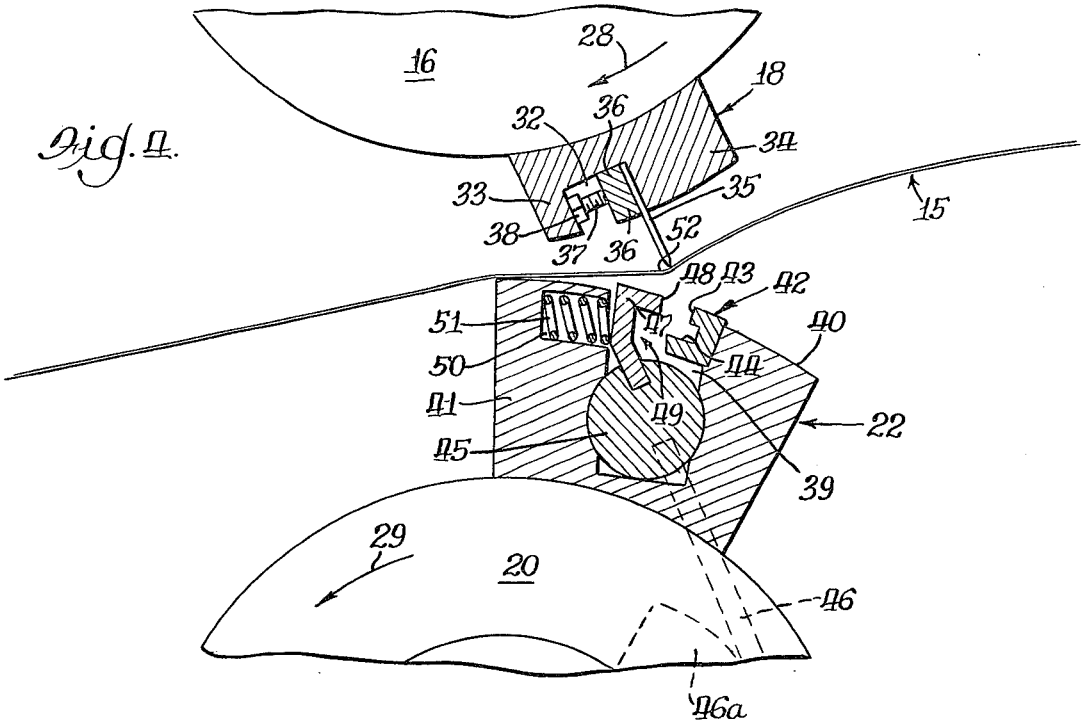
FIG. 4 is an enlarged detail sectional view of the combination tucker-gripper and knife-anvil mechanisms provided on certain of the rollers of FIGS. 1 and 2 with the printed web just about to be inserted into the combination cutting and gripping device.

FIG. 4 shows an enlarged view of the cooperative engagement of the first box 18 and the first box 22 on their respective rollers 16 and 20. In the particular position as shown, the boxes have not yet come into full tangential abutting relationship but rather are closely approaching that point. The box 18 has a generally central cut-out 32 defining spaced apart radial portions 33 and 34. A combined tucker and knife element 35 has its one end mounted in the cut-out 32 and its other outer end projecting radially outwardly substantially from the center of the first operational roller 16. A back-up block 36 abuts the side of the combined tucker and knife element 35 within the cut-out 32. A screw 37 threadedly engages the block 36. The screw is equipped with a hexagonal head 38 which abuts and cooperates with the radial portion 33 of the box 18. Thus, when the screw 37 is turned in one direction it causes the combination back-up block 36, screw 37 and hexagonally shaped head 38 to increase in overall length resulting in a snuggling of the combination tucker and knife element 35 against the radial portion 34 of the first box 18. Conversely when the screw 37 is turned in the opposite direction the overall length of this assembly decreases and thereupon the combination tucker and knife 35 is loosened for removal or servicing.

As shown in FIG. 4 the combination tucker and knife 35 engages the printed web 15 and commences the start of a bight therein for insertion into the elements of the first box 22 on the cooperative second operational roller 20. The box 22 similar to the box 18 has a cut-out 39 defining spaced apart radial portions 40 and 41. An insert member 42 is affixed to the radial portion 40. The fixed insert member 42 is provided with a stationary gripper jaw 43 at its outermost radially disposed position and is further provided with a protruding anvil member 44 at its radially innermost position. A cylindrical rod or roller member 45 is journally mounted in the box 22 between the spaced apart radially disposed portions 40 and 41 for rocking movement therein. A cam follower arm 46 engages the rod-like roller member 45 and projects radially outwardly therefrom to effect a rocking movement of the roller when the outer end of that follower arm 46 engages a cam 46*a* mounted on the shaft 21 which carries the second operational roller 20. The box 22 further includes a member 47 which has an arcuately swingable jaw 48. The swingable jaw 48 is arranged and constructed to cooperate with the stationary gripper jaw 43. The swingable member 47–48 is provided with a recess 49 to receive the protruding anvil member 44 when the jaw gripping elements 43 and 48 are in closed abutting relationship. The radially disposed portion 41 of the box 22 is provided with a transverse closed bottom recess 50 to receive a coil spring 51 therein in such a manner that the spring 51 exerts a force in a generally arcuate direction against the member 47 to thus normally urge the swingable jaw 48 toward a closed gripping position with the stationary jaw 43. However, in the relative position of the first and second operational rollers 16 and 20 as shown in FIG. 4 the cam follower 46 in cooperation with its cam 46*a* keeps the arcuately swingable jaw 47–48 away from its closing position with the stationary jaw 43. It is at this time that the combination tucker and knife 35 of the box 18 on the first operational roller 16 causes a dipping at 52 in the printed web 15 thereupon commencing the formation of a bight in that printed web.

Figure 5:
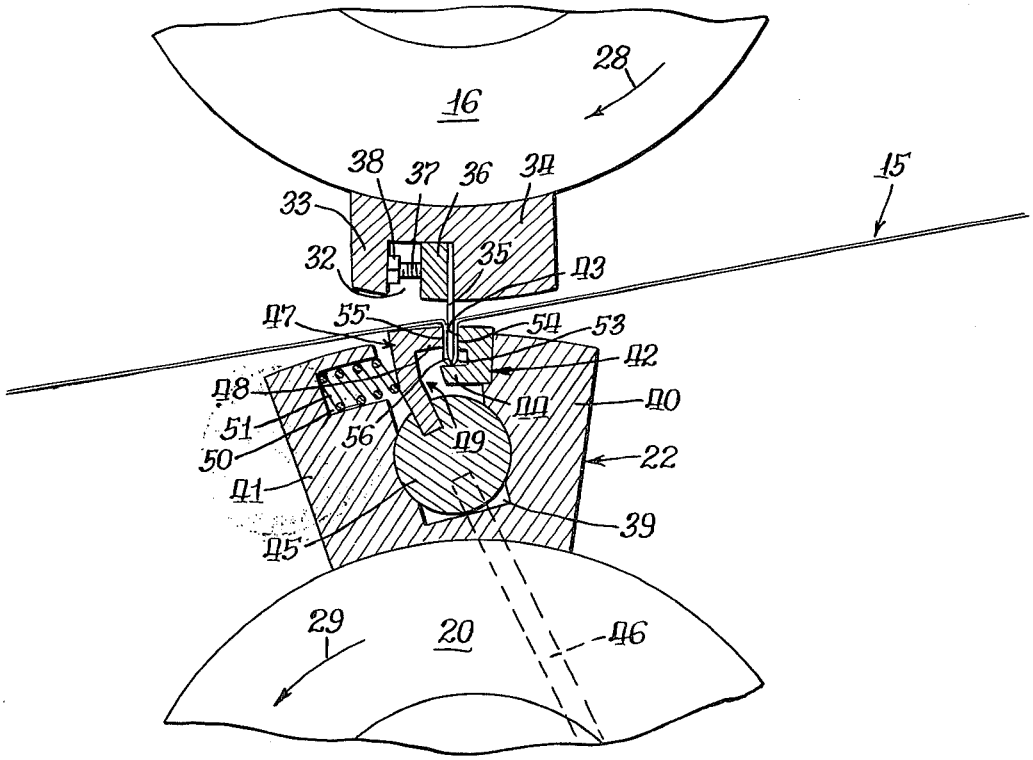
FIG. 5 is another enlarged detail sectional view of the device of FIG. 4 with the printed web being severed at its bight and the cut ends thereof about to be gripped by closing jaws.

As shown in FIG. 5 the rollers 16 and 20 have been rotated an amount such that the first box 18 on the roller 16 and the first box 22 on the roller 20 are substantially in abutting relationship such that the combination tucker and knife 35 has formed a full bight in the printed web 15 forming side flanking portions 54 and 55. The web bight 53 is tucked between the cooperative elements 42 and 47 and the knife end 56 of the combination tucker and knife 35 has cooperated with the anvil portion 44 to cut the bight 53 and separate the side flanking portions 54 and 55 of the web 15. At this point the jaws are not allowed full gripping by reason of the shape of the cam 46*a* on the shaft 21 and hence continued rotation of the operational rollers in the direction of the arrows 28 and 29 will cause the retraction of the combination tucker and knife 35–56 from its position within the box 22. Now with the tucker and knife removed the movable jaw 48 closes for a tight abutting relationship with the jaw 43 to thus grip the severed ends of the printed web 15 as identified by the flanking portions 54 and 55 thereof.

Figure 2:
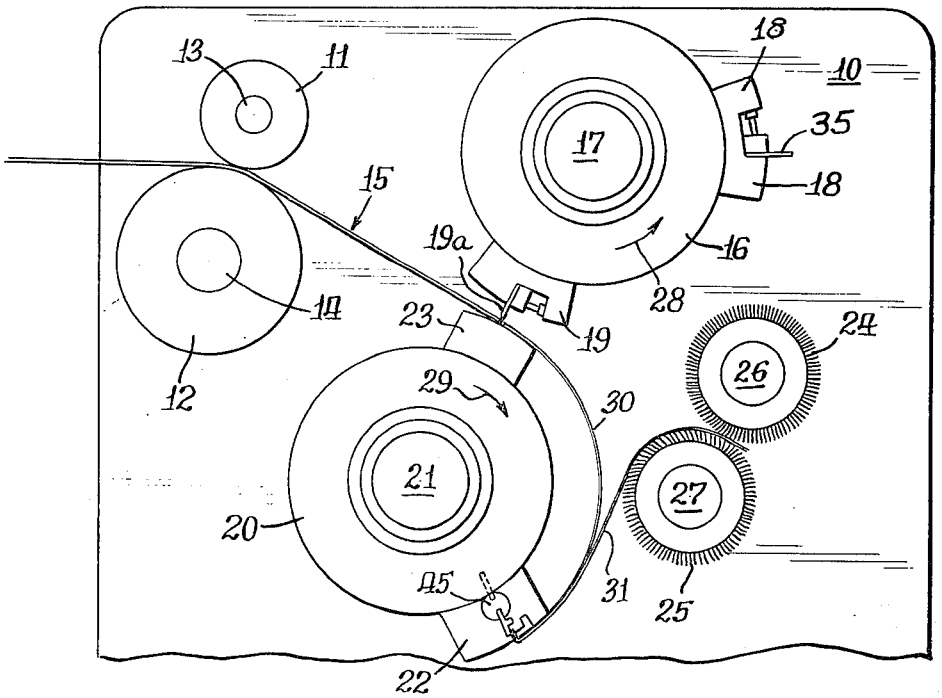
FIG. 2 is a vertical sectional view similar to that of FIG. 1 but with the rollers therein rotated to a succeeding position.

FIG. 1 shows the printed web 15 in its extended position throughout the folding and cutting device of this invention. FIG. 2 shows the printed web with its severed ends in gripped position in the combination gripper and anvil box 22 and the superposed portions extending up around the circumference of the second operational roller to a position over the anvil box 23 and beneath the box 19 on the first operational roller. The knife 19*a* in the box 19 passes through the web 15 against the cooperative anvil box 23. Thus the ends of the superposed cut web sheets are severed from the printed web 15 thereupon producing the superposed free ended cut sheets 30 and 31 with their angled ends 30*a* and 31*a* as shown in FIG. 3. It should be understood that the cooperative boxes 19 and 23 are of the single operational variety as shown in our previous, presently pending, application for patent mentioned above. In the event other operations are desired such as an additional folding or severing in any manner, that can be accomplished by the addition of more circumference boxes and/or a third operational roller such as shown in our previous application.

Figure 6:
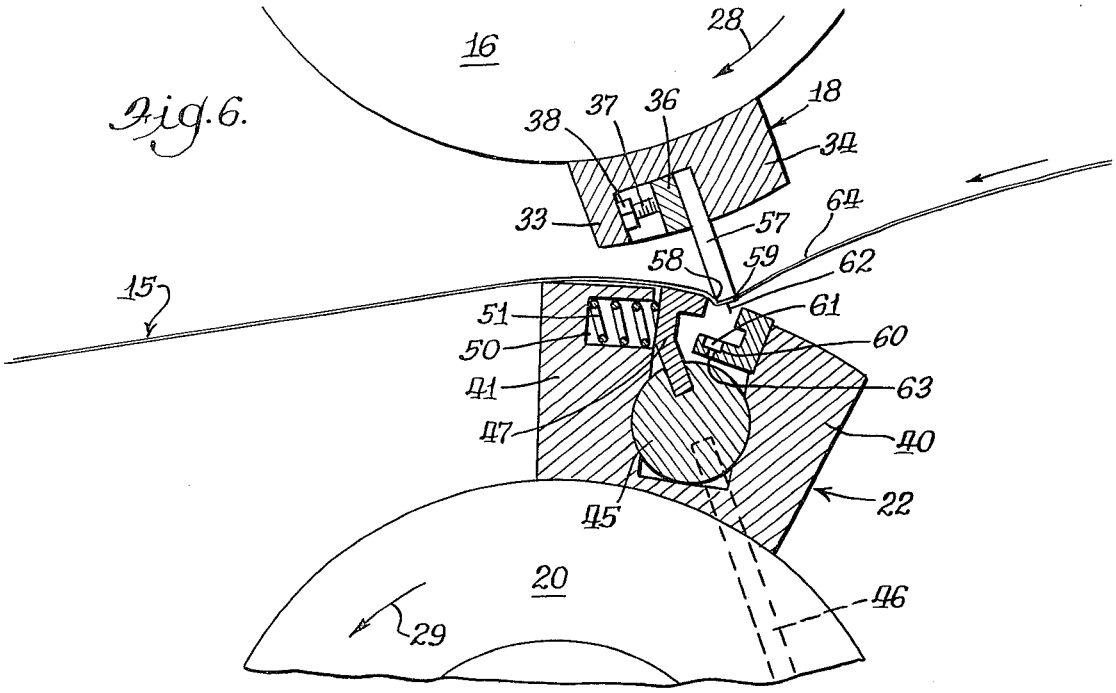
FIG. 6 is an enlarged detail sectional view of a modified cutting device in an embodiment similar to that of FIG. 4 and with the printed web about to be inserted in that modified cutting device.
Figure 7:
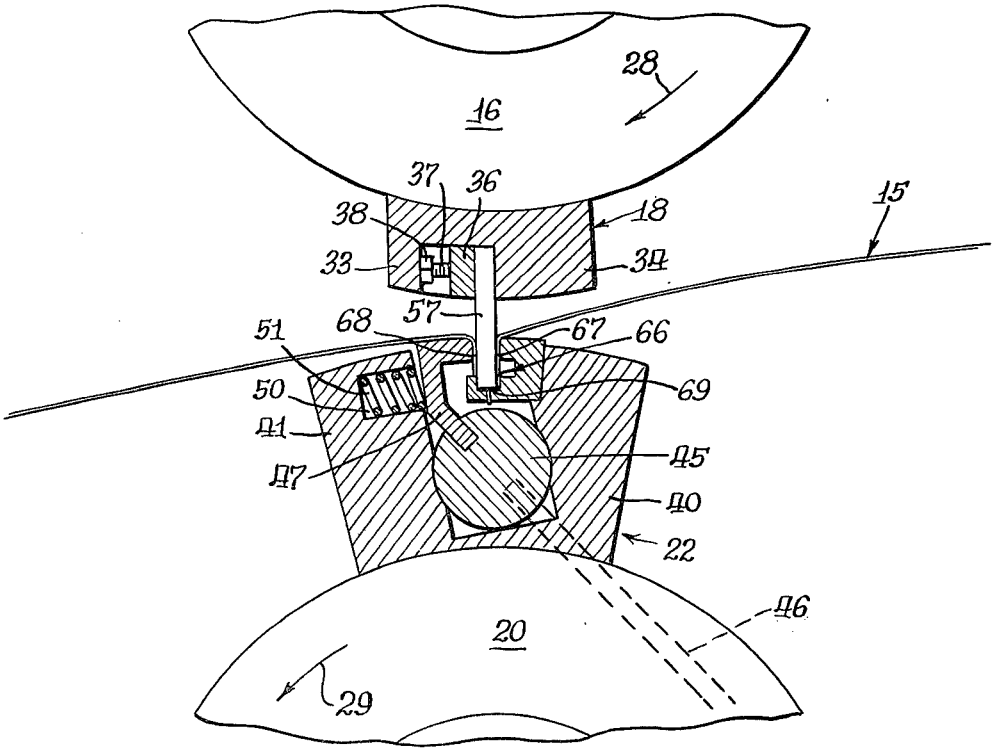
FIG. 7 is another enlarged detail sectional view of the device of FIG. 6 with the printed web being severed at the spaced apart sides of its wide tucker-knife and the cut ends thereof about to be gripped.

In the invention shown in FIGS. 1 through 5 the novel feature has been the cutting of the bight of the printed web simultaneously with the gripping of the two freed ends of the superposed web sheets. The modification of the invention shown in FIGS. 6 through 8 is similarly concerned with the cutting of the bight of the printed web and the simultaneous gripping of the two freed ends of that web. However, in this latter modification disclosed in FIGS. 6 through 8 the cutting of the web bight contemplates the use of a thick knife member causing the web to be cut at spaced apart positions the distance of the thickness of the combination tucker and knife. A piece of scrap web is formed between the two spaced apart web cuttings. This separated piece of scrap must be removed from the folding and cutting device of this invention.

Because the modification of FIGS. 6 through 8 contain most of the same elements as the device of FIGS. 1 through 5 it has been deemed advisable to utilize the same reference numerals to indicate the same parts. The box 18 of the first operational roller 16 in this modified form is provided with a combination tucker and knife 57. The knife comprises a member of substantial and uniform thickness. The combination tucker and knife 57 defines a front edge 58 and a spaced apart rear edge 59. This thick, combination tucker and knife 57 cooperates with a modified anvil ledge 60 in the box 22 of the second operational roller 20. This anvil ledge 60 is provided with a wide slot 61 therein to snuggly receive the thick, combined tucker and knife 57 in a telescoping manner. The front and rear edges 58 and 59 act as shears for the printed web bight as the knife commences its passage into the slot 61. The outermost radial end of the uniformly thick knife 57 is provided with a scrap pick-up pin 62 so that the pin itself projects radially outwardly from the end of the knife 57 in a relatively straight line. The wide slot 61 has a pin receiving hole 63 in the bottom thereof. The pin 62 on the end of the knife passes into and through the hole 63 after it has first passed through that portion of the printed web disposed between the front and rear knife edges 58 and 59 and hereafter called the scrap piece.

FIG. 6 depicts the operational roller boxes 18 and 22 just prior to their reaching abutting and tangential relationship. In FIG. 6 the thick combination tucker and knife 57 is shown entering the space between the gripping jaws 43 and 48 of the box 22. It is this action that produces a dip or deflection 64 in the printed web 15 preliminary to the formation of a full bight in the web 15. FIG. 7 shows the boxes 18 and 22 in alignment as the operational rollers 16 and 20 continue their rotation. At this time the web 15 has a bight 66 formed therein by the combination tucker and knife 57. The bight comprises spaced apart flanking portions 67 and 68 and it is at these side flanking portions that the web 15 is cut when the front and rear edges 58 and 59 of the knife enter the slot 61. The scrap piece of web identified by the numeral 69 is formed by the knife cutting the web at spaced apart positions. The pin 62 on the end of the knife has now impaled the scrap piece 69. Continued rotation of the operational rollers causes a withdrawal of the thick combination tucker and knife 57 and the subsequent complete closing of the jaws 43 and 48 acts to grip the now free and open ended flanking portions 67 and 68 of the printed web 15.

FIG. 8 shows a further subsequent position of the device of FIGS. 6 and 7 where the operational rollers have rotated causing the superposed web pieces to be pulled downwardly around the circumferential surface of the second operational roller while the first operational roller 16 with its unitary box 18 and its wide tucker knife 57 has moved upwardly away from the printed web 15. A stationary support 70 is provided on the folding and cutting device closely adjacent the first operational roller. This stationary support 70 is provided with a scrap stripping finger 71 depending therefrom. The stripping finger 71 acts to strip the scrap piece 69 from its impaled position on the end of the combination tucker and knife. When the piece of scrap 69 is freed from its pin impalement it drops down into a scrap receiving box 72. It should be understood that the device of FIGS. 6, 7 and 8 would similarly contain a simple cooperative knife and anvil in order to completely separate the web 15 from the incoming run of succeeding printed web portion in the same manner as that shown for the device of FIGS. 1 through 5.

The operation of the modified device of FIGS. 6, 7 and 8 of this invention is substantially identical to the operation of the device as shown in FIGS. 1 through 5 with the exception that the web bight is cut in spaced apart positions providing a scrap piece of web between those spaced cuts. Thus, the device of FIGS. 6, 7 and 8 requires a stripping of the scrap piece 69 of the printed web.

The device or devices of this invention are additive to the mechanisms shown in our previously filed and presently pending patent application such that a printer having these devices available is able to set up for the complete printing, folding and cutting of the printed web in any desired form of booklet, brochure or circular. The printer thus becomes extremely versatile in the jobs he can do without employing subsequent book binders or the like. The equipment defined in this application operates at the identical speed of the printing press to which this folder and cutter is an adjunct and thereupon the completed product is accomplished in the same time without delays for the accumulation of pages or any particular folding as was previously necessary in prior assemblies of printed matter.

We are aware that numerous details of construction may be varied throughout a wide range without departing from the principles disclosed herein and we therefore do not propose limiting the patent granted hereon otherwise than as necessitated by the appended claims.

What is claimed is:

1. In an apparatus for the printing industry of the type having first and second cooperative operational rollers which have a continuously printed web fed therebetween, comprising a first tool carrying box adjustably mounted on the outer circumference of the first of said cooperative operational rollers, said first tool carrying box having a tool of a combination web tucker and knife projecting radially outwardly from said first operational roller, a second tool carrying box adjustably mounted on the outer circumference of the second of said cooperative operational rollers, said second tool carrying box having a tool of combination web grippers and an anvil, said cooperative operational rollers rotatably driven in opposite directions and the first and second boxes arranged on said rollers to tangentially engage each other during rotation, means opening and closing said web grippers at desired times during the rotation of said rollers, the said web grippers being in an open condition at a time when the first and second boxes are approaching an adjoining tangential relationship to permit the combination web tucker and knife to push a bight portion of the printed web into the open web grippers and causing the knife to sever the bight portion of the web when the knife engages the anvil of the combination web grippers and an anvil causing the formation of severed ends of the printed web, and when said boxes start separating again by continued rotation of the rollers the combination web tucker and knife pulls out of the web grippers and the web grippers close on and hold the severed ends of the printed web, said web grippers comprising a stationary jaw having a web gripping portion and a movable jaw having a web gripping portion arranged and constructed to move toward and away from the stationary jaw to effect a gripping of the printed web by the cooperation of the web gripping portions, and one of said jaws having an anvil located beneath its web gripping portion thereof and projecting toward the other of said jaws, and the other of said jaws having a cooperative recess located beneath its web gripping portion thereof and adapted when the jaws are in closed gripping position to telescopically receive the projecting anvil.

2. A device as set forth in claim 1 in which the stationary jaw has the anvil and the movable jaw has the cooperative recess.

3. A device as set forth in claim 1 in which the anvil comprises a generally flat uninterrupted surface to be engaged by the combination web tucker and knife for severing the bight portion formed in the printed web on a line type cut.

4. A device as set forth in claim 1 in which the combination web tucker and knife has substantial thickness to define spaced side walls, and the anvil has a generally flat surface with a slot therein to snuggly receive the spaced side walls of the combination web tucker and knife for effecting a severing of the bight portion formed in the printed web on the spaced apart lines at the sides of the slot and leaving a cut-out scrap of bight portion therebetween.

5. A device as set forth in claim 4 in which the combination web tucker and knife is provided with a pin extending radially outwardly from its outer radial end and between its spaced side walls, and said slot having a pin receiving hole in the bottom thereof whereby the pin penetrates the cut-out scrap.

6. A device as set forth in claim 5 in which there is included means to strip the cut-out scrap from the pin.

7. A device as set forth in claim 6 in which the means to strip the cut-out scrap comprises a stripping finger mounted in a stationary position adjacent the first operational roller at a position spaced from the second operational roller and adapted when the first operational roller and its first tool carrying box passes the stripping finger to strip the cut-out scrap from the pin.

* * * * *